US006753835B1

(12) United States Patent
Sakai

(10) Patent No.: US 6,753,835 B1
(45) Date of Patent: Jun. 22, 2004

(54) METHOD FOR DRIVING A LIQUID CRYSTAL DISPLAY

(75) Inventor: Hideaki Sakai, Moriyama (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/388,648

(22) Filed: Sep. 2, 1999

(30) Foreign Application Priority Data

Sep. 25, 1998 (JP) ..... 10-270793

(51) Int. Cl.[7] ..... G09G 3/36
(52) U.S. Cl. ..... 345/87; 345/98; 345/100
(58) Field of Search ..... 345/87, 98

(56) References Cited

U.S. PATENT DOCUMENTS 5,105,288 A * 4/1992 Senda et al. ..... 345/87
5,867,141 A * 2/1999 Asada et al. ..... 345/100
5,912,651 A * 6/1999 Bitzakidis et al. ..... 345/58
5,940,055 A * 8/1999 Lee ..... 345/87
6,396,469 B1 * 5/2002 Miwa et al. ..... 345/87

* cited by examiner

*Primary Examiner*—Steven Saras
*Assistant Examiner*—William C. Spencer
(74) *Attorney, Agent, or Firm*—Scully, Scott, Murphy & Presser; Robert M. Trepp, Esq.

(57) ABSTRACT

The liquid crystal display is a "Cs on Gate type" active matrix liquid crystal display in which an auxiliary capacitor is formed by each pixel electrode and an adjacent gate line. By driving gate lines sequentially line by line to control the potential of the pixel electrode through the auxiliary capacitor Cs at a predetermined time before one frame period ends, a blanking (BL) writing is performed, thereby for forcedly blanking a display.

5 Claims, 3 Drawing Sheets

METHOD FOR DRIVING A LIQUID CRYSTAL DISPLAY

BACKGROUND OF THE INVENTION

1. Field of the Invention

The present invention relates to a method for driving a liquid crystal display, and more particularly, to a driving method which enables the after-image phenomenon to be reduced.

2. Discussion of the Prior Art

Recently, active matrix liquid crystal displays are widely used in which switching elements such as thin film transistors (TFTs) and pixel electrodes are arranged in a matrix. However, since the liquid crystal display is capacitive, it has a hold type luminous characteristic, and data once written into a pixel is held until it is rewritten after one frame period. Thus, it has a problem that after-image is conspicuous as compared with the inpulse type luminous display such as the CRT display, which instantaneously emits light within one frame period, and in particular, the display characteristics degrade when displaying a motion picture.

As a countermeasure for the after-image problem, Japanese Published Unexamined Patent Application No. 64-82019 proposes to control backlight. The illuminating equipment for backlight consists of an array of a plurality of lamps, which are sequentially turned on and off according to the timing of line scanning of liquid crystal display. Each lamp covers a group of a predetermined number of (e.g. 44) scanning lines. Each lamp lights up when all the scanning lines of the associated group are driven, and goes out after the elapse of a fixed time. However, in this case, since blanking (erasure of a display) is performed on a group-by-group basis, there is a problem that blanking cannot be controlled for each scanning line.

To solve the problem of the Japanese Published Unexamined Patent Application No. 64-82019, U.S. patent application Ser. No. 150,975 filed on Sep. 11, 1998 and entitled "A METHOD OF DISPLAYING AN IMAGE ON LIQUID CRYSTAL DISPLAY AND A LIQUID CRYSTAL DISPLAY" assigned to the assignee of the present invention discloses a method in which the liquid crystal panel is divided into the upper half and the lower half. The liquid crystal panel is controlled to simultaneously drive a pair of gate lines (one from the upper half and one from the lower half). The upper and lower half gate lines are sequentially driven line by line as a pair to display data for one frame in a predetermined period of one frame period (for instance, the first half of one frame), and in the remaining period of one frame (for instance, the latter half of one frame), they are sequentially re-driven line by line as a pair to forcedly write a blanking image (black image). This method is to shorten the lighting time or display time by forcedly writing black in the same frame period, whereby the after-image problem can be properly solved. However, the liquid crystal panel needs to be divided into two, and a special gate line driver circuit for simultaneously driving the panel halves and two data line driver circuits for independently driving each panel half are required, which leads to a problem that the panel structure and the driver circuits become complicated. Further, since one frame period is divided into two, the first one assigned to displaying and the second one assigned to blanking, the blanking time cannot be changed without changing the display time. Accordingly, there is a problem that the blanking time cannot be freely set without affecting the displaying of an image.

SUMMARY OF THE INVENTION

Accordingly, it is an object of the present invention to provide a method for driving a liquid crystal display, which can advantageously solve the after-image problem by controlling the blanking on a scanning line-by-scanning line basis, without requiring any special panel structure or driver circuit.

The present invention is a method for driving an active matrix liquid crystal display having thin film transistors and pixel electrodes at the intersections of gate lines receiving a scanning signal and data lines receiving a data signal, each pixel electrode and an adjacent gate line forming an auxiliary capacitor. The driving method of the present invention comprises a step of writing data into the pixel electrode sequentially line by line in response to the scanning signal and the data signal to display an image for a frame, and a step of driving the gate lines sequentially line by line at a predetermined time before the period of a frame ends to control the potential of the pixel electrodes through the auxiliary capacitors thereby for forcedly blanking a display. Preferably, the blanking is performed by writing a black level, and the auxiliary capacitor is formed by the associated pixel electrode and the preceding gate line.

The after-image problem can advantageously be solved by controlling the blanking on a scanning line-by-scanning line basis, without requiring any special panel structure. Further, optimization can be made by freely setting the blanking time, without affecting the image display.

DETAILED DESCRIPTION OF THE PREFERRED EMBODIMENT

Now, a preferred embodiment of the present invention is described with reference to the drawings. The active matrix liquid crystal display of the present invention uses a liquid crystal panel in which a pixel electrode and an adjacent gate line on an array substrate form an auxiliary storage capacitor. As is well known in the art, the auxiliary capacitor of this type is formed by constructing the array substrate so that an end area of the pixel electrode positionally overlaps with the adjacent gate line, and it is normally called a "Cs on Gate type" auxiliary capacitor. In the embodiment of the present invention, description is made on the assumption that the auxiliary capacitor is formed by the pixel electrode and the preceding gate line.

Figure 1:
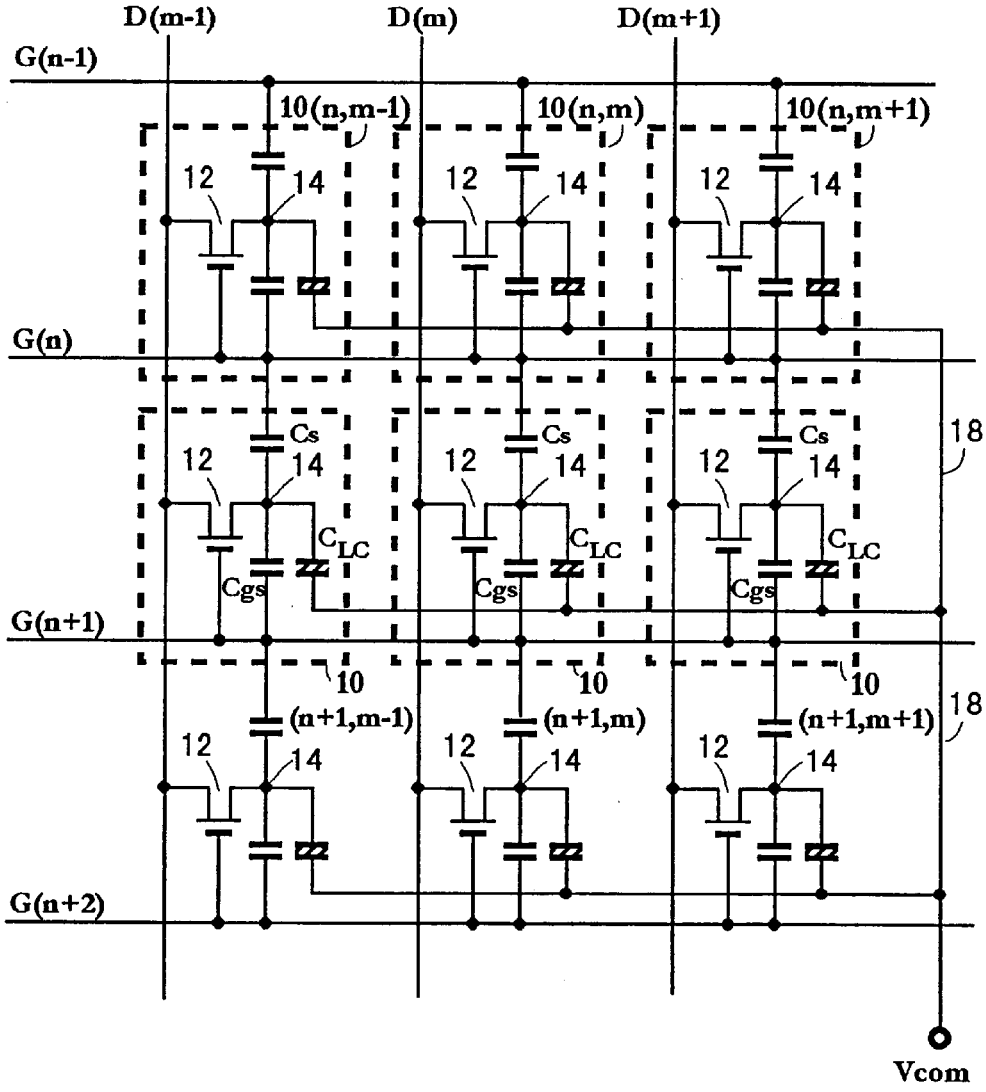
FIG. 1 is an electric equivalent circuit of the liquid crystal panel to which the present invention is applicable.

FIG. 1 is the electric equivalent circuit for part of the Cs on Gate type liquid crystal panel. The liquid crystal panel has a plurality of data lines D(m−1), D(m), and D(m+1), and gate lines G(n−1), G(n), G(n+1), and G(n+2), which are formed on an array substrate. It is to be understood that there are actually provided more data lines and gate lines. At the intersections of the data lines and gate lines, there are liquid crystal cells 10 arranged in a matrix. Each liquid crystal cell includes a thin film transistor (TFT) 12. The drain electrodes of the TFTs 12 in each column are connected to an associated data line D, and the gate electrodes of the TFTs 12 in each row are connected to an associated gate line G. Data lines D simultaneously receive an image data signal, and gate lines G receive a scanning signal for driving the liquid crystal cell lines or rows sequentially line by line.

The source of a TFT 12 is connected to a pixel electrode shown as a node 14. The pixel electrode of each liquid crystal cell 10 forms an auxiliary storage capacitor Cs in conjunction with the gate line in the preceding stage. A capacitor Clc is a liquid crystal capacitor that is given by the liquid crystal between each pixel electrode 14 and a common electrode (opposing electrode) 18 on an opposing substrate (namely, a color filter (CF) substrate). A parasitic capacitor Cgs exists between the gate and the source of a TFT 12.

Figure 2:
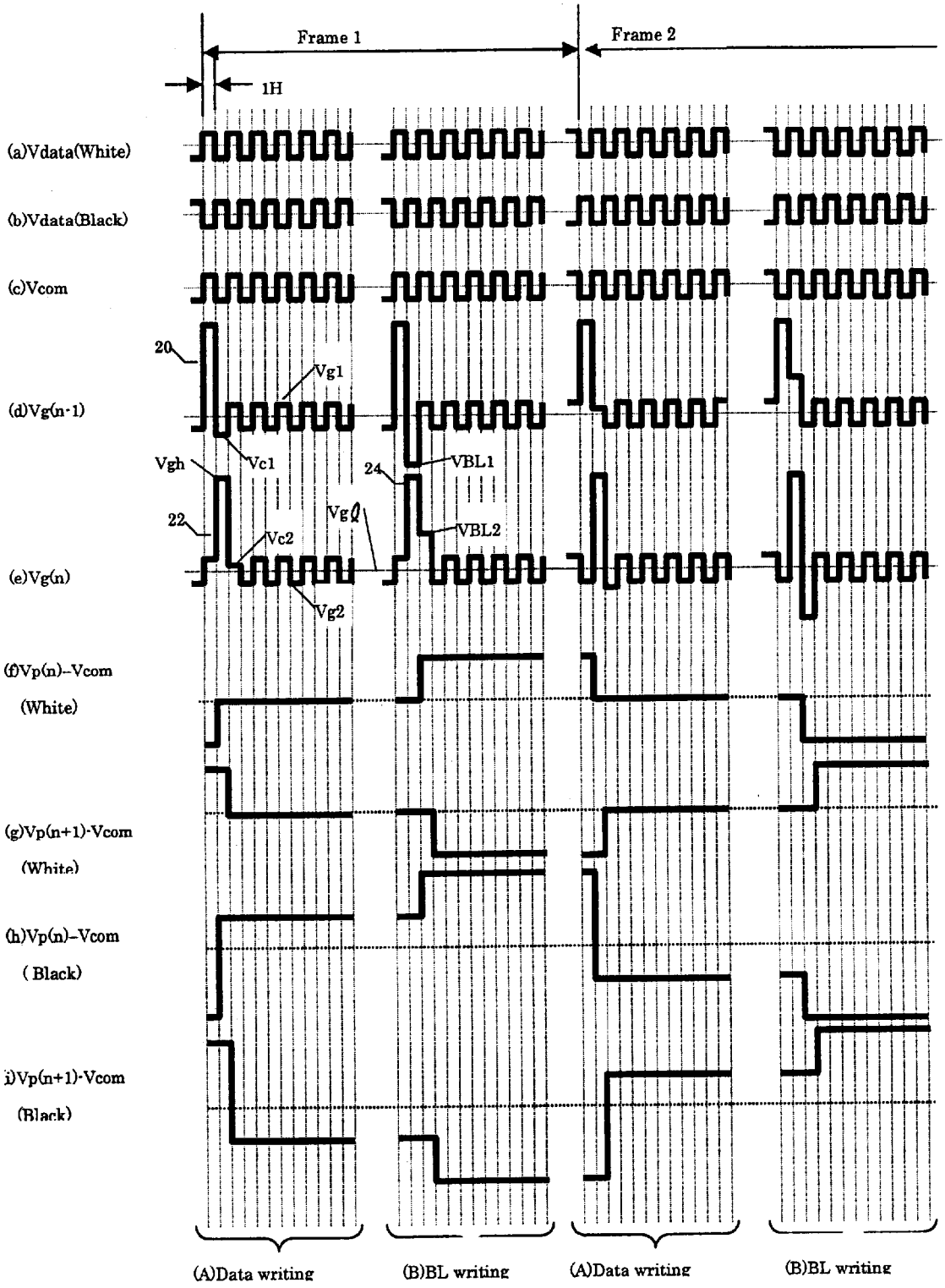
FIG. 2 is a waveform diagram showing the normal data write operation, and the blanking write operation according to the present invention.

FIG. 2 shows an example of operational waveforms suitable for operating the liquid crystal panel of FIG. 1. In FIG. 2, the left part designated as "(A) Data writing" shows the conventional write operation, while the right part designated as "(B) BL writing" shows the blanking write operation used by the present invention to reduce the after-image. First, the conventional write operation on the left side is described.

FIG. 2 illustrates an operation in a normally white mode. Waveform (a) represents white (full white) write data "Vdata (white)" supplied to data lines D, waveform (b) represents black (full black) write data "Vdata (black)" supplied to data lines D, waveform (c) represents the voltage Vcom of the common electrode, waveform (d) represents the gate line voltage Vg(n−1) of the preceding stage, and waveform (e) represents the voltage Vg of the gate line being currently scanned. Waveform (f) represents the voltage across the liquid crystal of the liquid crystal cells along gate line G(n) when white is written into the cells, and waveform (g) represents the voltage appearing across the liquid crystal of the liquid crystal cells along gate line G(n+1) when white is written into the cells. Waveform (h) represents the voltage across the liquid crystal of the liquid crystal cells along gate line G(n) when black is written into the cells, and waveform (i) represents the voltage across the liquid crystal of the liquid crystal cells along gate line G(n+1) when black is written into the cells.

As seen from FIG. 2, a.c. driving is used in this example, that is, line (row) inversion driving, common electrode reverse driving, gate electrode inversion driving, and frame inversion driving are used. That is, the data signal Vdata is inverted for each horizontal scanning period (1H) to reduce d.c. component induced by dielectric anisotropy of the liquid crystal.

Accordingly, the liquid crystal cells in the adjacent rows are driven in opposite polarities. Further, to reduce the driving ability and withstand voltage required for the data line driver circuit by sharing the voltage required for data writing between the data line driver circuit and the common electrode, the voltage Vcom of the common electrode is also driven in synchronism with the data signal. The voltage Vcom is also inverted in polarity for each horizontal scanning period. The voltage of (Vdata−Vcom) is applied to the liquid crystal when the TFT is turned on. Further, since the gate line G is coupled with the pixel electrode through the auxiliary capacitor Cs, the gate line voltage Vg has an effect on the pixel electrode 14. Accordingly, in order that the voltage of (Vdata−Vcom) is accurately applied across the liquid crystal in the writing, the gate line voltage needs to be prevented from affecting the voltage of the pixel electrode. For this, the voltage of the gate line is normally inversion-driven for each horizontal scanning period with the same polarity and same amplitude as the common electrode voltage Vcom. The voltages of the gate lines of rows for which no writing is performed and of the common electrode vary between Vg1 and Vg2. In addition, these driving signals are inverted for each frame to reduce the d.c. component. Such inversion driving method is known in the art, as disclosed in Japanese Published Unexamined Patent Application No. 06-59245 and as such does not constitute the present invention.

It is to be noted that, in FIG. 2, the horizontal lines shown in waveforms (a) to (e) are the center voltages of the respective a.c. drive waveforms, and the horizontal lines of waveforms (f) to (i) represent a 0 V level.

The pulses 20 and 22 of the waveforms (d) and (e) are gate driving pulses for turning the TFTs 12 on for writing. When the gate pulse is applied to the TFTs 12 and the TFTs are turned on, associated pixel electrodes 14 are charged to Vdata. When the gate pulse is turned off, the potential of the pixel electrodes 14 feeds through to the gate line via the parasitic capacitors Cgs, and the pixel electrode potential drops. Such pixel electrode potential drop is called a "feedthrough voltage." To compensate for this potential drop, the gate line in the preceding stage is simultaneously driven to a predetermined level upon writing. If the gate line being currently driven is G(n), then the preceding gate line G(n−1) is driven with a compensation voltage Vc1 simultaneously with the gate pulse 22. The compensation voltage Vc1 is coupled with the pixel electrodes 14 via the auxiliary capacitors Cs to compensate for the feedthrough voltage. Then, when the gate line G(n+1) is driven, the preceeding gate line G(n) is simultaneously driven with a compensation voltage Vc2, thereby to compensate for the pixel electrode potential of the stage G(n+1) through the auxiliary capacitor Cs. Since the adjacent rows are inversion-driven, the compensation voltages Vc1 and Vc2 applied to the adjacent gate lines have polarities opposite to each other. The compensation of such feedthrough voltage or effective value is known in the art, as shown in Japanese Published Unexamined Patent Application Nos. 64-26822 and 09-179097, and as such does not constitute the present invention.

Now, the driving method according to the present invention for reducing the after-image is described. The present invention has found that the voltage control of an adjacent gate line, which has conventionally been used for compensating for the "feedthrough voltage", can be effectively used for preventing the after-image. Since the after-image occurs because of the display time of an image being long as compared with one frame period, the after-image effect can be reduced by writing a blanking image to forcedly erase the display so that the image display time in one frame is shortened. The blanking image is a non-significant image of the same gray scale, and it is preferably a black image. In the present invention, a blanking writing is performed concurrently with data display at a pixel electrode of a current scan line by controlling the voltage of the pixel electrode currently scanned according to a blanking voltage control provided by the adjacent gate line (in this example, the gate line in the preceding stage).

Figure 3:
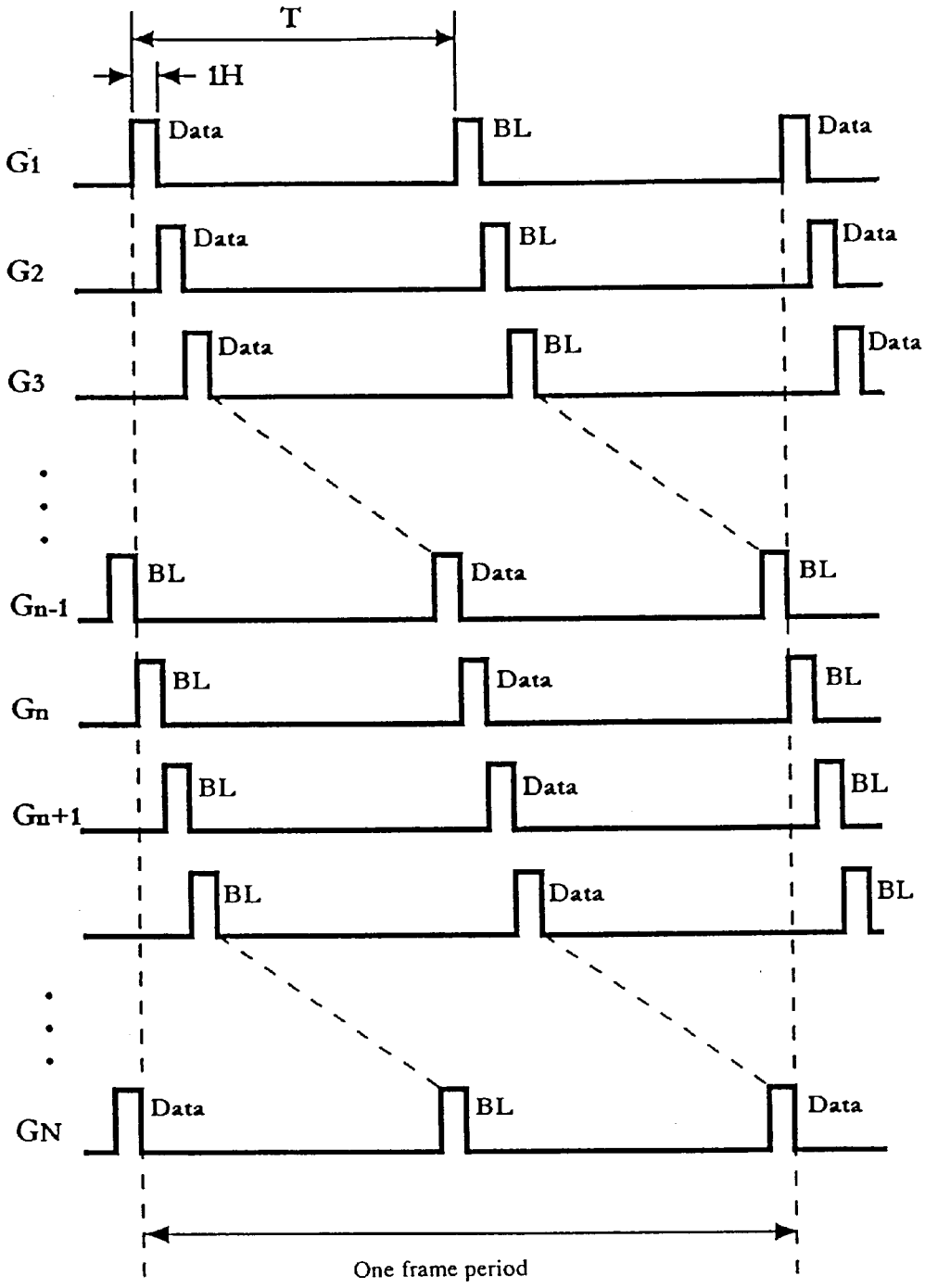
FIG. 3 is a diagram showing the timings of the normal data write operation and the blanking write operation according to the present invention.

FIG. 3 shows the normal image data write timing, and the black level write timing for blanking according to the present invention. It is herein assumed that the non-interlaced sequential line scanning is employed. "Data" represents the writing of image data, and "BL" represents a black level writing for blanking. Image data is written sequentially line by line, one horizontal scanning line (1H) at a time. When a predetermined time T shorter than one frame period elapses after the frame start time, a black writing is forcedly performed sequentially line by line, one horizontal scanning line at a time.

Returning to FIG. 2, the right part of FIG. 2 is a timing chart exemplifying the operation performed in the blanking writing BL in FIG. 3. When the time T elapses after the frame start time, the first gate line to be blanked is selected, and the voltage of the preceding gate line is controlled so as to put the pixel electrode potential of all the liquid crystal cells along the selected gate line at a black level. If the selected gate line is G(n), the gate line G(n) is driven by a gate pulse 24, and simultaneously the preceding gate line G(n−1) is driven by a blanking voltage VBL1. Since the data writing and the blanking writing concurrently proceed on the liquid crystal panel, as described with reference to FIG. 3, the liquid crystal cells along the gate line G(n) also receive image data at the data line. Accordingly, the image data on the data line is written into the liquid crystal cells along the gate line G(n), but all the pixel electrode potentials along the gate line G(n) are modified to be set to the black level by the blanking voltage of the preceding gate line. When a gate line G(n+1) is selected in the next horizontal scanning period, the gate line G(n) is driven by a blanking voltage VBL2 as the preceding gate line. By this, the pixel electrodes of all the liquid crystal cells along the gate line G(n+1) are written to the black level. Thereafter the blanking writing is similarly performed sequentially line by line.

The blanking writing by the driving of the preceding gate line is specifically described below. The blanking writing is carried out by applying a blanking voltage to the preceding gate line simultaneously with the data writing. Accordingly, in the blanking writing, it is required that black can be written regardless of the voltage of the data line. When there is a data write to the liquid crystal cells along a selected gate line, preferably, a blanking voltage is applied to the preceding gate line. Under these conditions, the pixel electrode charge Q during the writing time is governed by the equation (1). During the hold state, i.e., after the writing time, the pixel electrode charge Q is governed by the equation (2).

$$Q=Cgs\ (V-Vgh)+Cs\ (V-Vcs)+Clc\ (V-Vcom) \quad (1)$$

$$Q=Cgs\ (V'-Vgl+Cs\ (V'-Vgl+Clc(V'-Vcom) \quad (2)$$

where

- V: voltage appearing at the pixel electrode upon writing (corresponding to Vdata),
- V': voltage held at the pixel electrode after the writing,
- Vgh: high level of the gate driving pulse applied to the selected gate line,
- Vcs voltage applied to the preceding gate line,
- Vcom: voltage of the common electrode (opposing electrode),
- Vgl: low level of the gate driving pulse (corresponding to the intermediate level between Vg1 and Vg2),
- Cgs: gate-source parasitic capacitor,
- Cs: auxiliary capacitor, and
- Clc: liquid crystal capacitor.

From the equations (1) and (2), the following is obtained.

$$(Cgs+Cs+Clc)(V-V')=Cgs\ (Vgh-Vgl)+Cs\ (Vcs-Vgl) \quad (3)$$

$$(V-V')=[CgsVgh-(Cgs+Cs)Vgl+CsVcs]/(Cgs+Cs+Clc) \quad (4)$$

Accordingly, $$d(V-V')/dVcs=Cs/(Cgs+Cs+Clc) \quad (5)$$

Thus, by controlling the voltage Vcs of the preceding gate line, the pixel electrode voltage in the hold state can be controlled. As seen from the equation (5), the greater the auxiliary capacitor Cs, the larger the change width of the pixel voltage can be made, but the auxiliary capacitor used in the conventional "Cs on Gate type" liquid crystal display panel is sufficient.

An example of the voltage of the preceding gate line which is required for blanking writing is shown. To show an example of the capacitor values Cgs, Cs, and Clc of the liquid display, Cgs=0.01 pF, Cs=0.165 pF, Clc(max)=0.416 pF, and Clc(min)=0.169 pF. Clc(max) is for black writing, and Clc(min) is for white writing. From the equation (5), $$d(V-V')/dVcs=0.279\ [\text{for } Clc(\max)] \quad (6)$$

$$d(V-V')/dVcs=0.479\ [\text{for } Clc(\min)] \quad (7)$$

Assuming that the voltage appearing on the pixel electrode in the white writing (which corresponds to the data line voltage) is denoted by Vdata (white), the voltage held on the pixel electrode after the white writing is denoted by V' (white), the voltage of the preceding gate line in the white writing is denoted by Vcs (white), the voltage held on the pixel electrode after the blanking (black) writing is denoted by V' (black), and the voltage of the preceding gate line in the blanking writing is denoted by Vcs (black), the following relations are obtained from the equation (4).

$$[Vdata(\text{white})-V'(\text{white})]=[CgsVgh-(Cgs+Cs)Vgl+CsVcs\ (\text{white})]/(Cgs+Cs+Clc) \quad (8)$$

$$[Vdata(\text{white})-V'(\text{black})]=[CgsVgh-(Cgs+Cs)Vgl+CsVcs\ (\text{black})]/(Cgs+Cs+Clc) \quad (9)$$

Accordingly, $$V'(\text{white})-V'(\text{black})=[-Cs/(Cgs+Cs+Clc)][Vcs(\text{white})-Vcs(\text{black})] \quad (10)$$

V' (white)−V' (black) is 4.7 V in this example. From the equations (5) and (7), [−Cs/(Cgs+Cs+Clc)] is 0.479 for the white writing (when Clc is minimum).

Accordingly, $$[Vcs(\text{white})-Vcs(\text{black})]=[V'(\text{white})-V'(\text{black})]/[-Cs/(Cgs+Cs+Clc)]=4.7/(-0.479)=-9.8\ (V) \quad (11)$$

This shows that, to perform a blanking writing when a white level exists on the data line, it is necessary to change the voltage Vcs of the preceding gate line at least by −9.8 (V) from the white writing. Since the liquid crystal is actually a.c. driven, and the driving voltages on the adjacent cell lines have opposite polarities, Vcs (black) needs to change in the range of ±9.8 V relative to its center voltage.

Since Vcs must not turn on the TFTs in the preceding cell line, Vcs should not exceed the maximum voltage that does not turn on the TFTs. In one example, this maximum voltage is −7.5 V. In this case, the center voltage of Vcs is −17.3 V, and the amplitude is ±9.8 V. Accordingly, for instance, the voltage can be set as follows.

High level of gate driving pulse Vgh =19 V (same as before) High level of blanking voltage Vcs VBL2 =−7.5 V Low level of blanking voltage Vcs VBL1 =−27.1 V Center voltage of Vcs =−17.3 V The low level Vgl of the gate voltage corresponds to the center level between the Vg1 level and the Vg2 level shown in FIG. 2, and it is approximately equal to the center voltage of Vcs. In practice, Vgl is a.c. driven between the Vg1 level and the Vg2 level, as described above in connection with FIG. 2. The change width of Vgl is ±2.35 V, which corresponds to ½ of 4.7 V, the difference between the white pixel voltage and the black pixel voltage. Further, the center voltage of Vcs slightly deviates from the nominal value by the above described feedthrough voltage compensation, and thus, generally it does not completely match the center level Vgl of the gate voltage.

The voltage level of −27.1 V is about two times larger than the minimum level of the gate line voltage, −11.5 V, which has conventionally been used for compensating for the "feedthrough voltage," but it can be fully implemented by the ordinary CMOS circuit.

Since the reduction in the time T decreases the brightness, the time T needs to be selected to optimize the brightness and after-image. According to an experiment, the image display time or lighting time preferably occupies 20% to 75% of one frame period, and in particular, preferably 30% to 60%. Accordingly, the time, (one frame period-T), is preferably 80% to 25% of one frame period, and in particular, preferably 70% to 40%.

To blank a display within one frame period according to the present invention, the liquid crystal is preferably the one having fast response characteristics. One frame period is normally 17 ms, and for instance, the time corresponding to 50% of it is 8.5 ms. Accordingly, in order that the present invention is effective, the response time is preferably 8 ms at longest, more preferably 3 ms or shorter. As such fast-response liquid crystal, bend-alignment cell (π cell) is known, which is especially preferable, but other fast-response cells such as ferroelectric liquid crystal may be used.

The black level for blanking does not need to match the black level of data. To fulfill the purpose of blanking, it is only needed that the blanking signal has a fixed potential, and can give a non-image state. Further, in the embodiment of the present invention, description has been made on the assumption that the auxiliary capacitor is defined by the pixel electrode and the preceding gate line, but the present invention may be applied to a liquid crystal panel in which the auxiliary capacitor is defined by the pixel electrode and the succeeding gate line. Furthermore, the present invention may be applied for reducing the after-image in a liquid crystal display of the normally black mode.

What is claimed is:

1. A method for driving an active matrix liquid crystal display having thin film transistors and pixel electrodes at the intersections of gate lines receiving a scanning signal and data lines receiving a data signal, each said pixel electrode and an adjacent gate line forming an auxiliary capacitor, said method comprising the steps of:

writing data into said pixel electrodes sequentially line by line in response to said scanning signal and said data signal to display an image for a frame; and driving said gate lines sequentially line by line at a predetermined time before the period of a frame ends to control the potential of said pixel electrodes through said auxiliary capacitors thereby for forcedly blanking a display.

2. The driving method as set forth in claim 1, wherein said blanking is performed by a writing of a black level.

3. The driving method as set forth in claim 1 or 2, wherein the length from the start time of a frame to said predetermined time is 25% to 80% of the period of a frame.

4. The driving method as set forth in claim 1 or 2, wherein the length of the start time of a frame to said predetermined time is 40% to 70% of the period of a frame.

5. A driving method as set forth in claim 1 or 2, wherein each said auxiliary capacitor is formed by the associated pixel electrode and the preceding gate line.

* * * * *